US009581151B2

(12) United States Patent
Spiegl et al.

(10) Patent No.: US 9,581,151 B2
(45) Date of Patent: Feb. 28, 2017

(54) CYLINDER HEAD FOR A PISTON COMPRESSOR

(71) Applicants: Bernhard Spiegl, Vienna (AT); Andreas Brandl, Vienna (AT); Roland Cesak, Schwabbruck (DE)

(72) Inventors: Bernhard Spiegl, Vienna (AT); Andreas Brandl, Vienna (AT); Roland Cesak, Schwabbruck (DE)

(73) Assignee: Hoerbiger Kompressortechnik Holding GmbH, Vienna (AT)

( * ) Notice: Subject to any disclaimer, the term of this patent is extended or adjusted under 35 U.S.C. 154(b) by 443 days.

(21) Appl. No.: 14/081,079

(22) Filed: Nov. 15, 2013

(65) Prior Publication Data

US 2014/0134022 A1 May 15, 2014

(30) Foreign Application Priority Data

Nov. 15, 2012 (AT) ..... A 50515/2012

(51) Int. Cl.
*F04B 39/12* (2006.01)
*F04B 49/22* (2006.01)
(Continued)

(52) U.S. Cl.
CPC ..... *F04B 39/125* (2013.01); *F04B 39/08* (2013.01); *F04B 39/10* (2013.01); *F04B 49/03* (2013.01); *F04B 49/225* (2013.01)

(58) Field of Classification Search
CPC ..... F04B 39/10; F04B 39/125; F04B 27/24; F04B 39/08; F04B 49/03; F04B 49/225; F04B 53/1012
See application file for complete search history.

(56) References Cited

U.S. PATENT DOCUMENTS 1,345,884 A 7/1920 Rix
2,956,729 A 10/1960 Nicholas
(Continued)

FOREIGN PATENT DOCUMENTS

EP 475931 3/1992
FR 2257029 8/1975

OTHER PUBLICATIONS

English Abstract of EP 475931.

*Primary Examiner* — Dominick L Plakkoottam
(74) *Attorney, Agent, or Firm* — Dykema Gossett PLLC

(57) ABSTRACT

An unloader ring 20 has a plurality of unloader fingers 21 passing through intake channels 16 of the intake valve 5 arranged in the ring-shaped intake chamber 11 such that the unloader ring 20 is guided on the wall 24, 31 of the intake chamber 11, where it is arranged displaceably by means of the circumferential surface 23 of the unloader ring 20 on the outside radially or by the circumferential surface 30 of the unloader ring 20 on the inside radially. A radial step 25 is provided on the circumferential surface 23 of the unloader ring on the outside radially or on the circumferential surface 30 of the unloader ring 20 on the inside radially, and a control chamber 26 is formed between the wall 24, 31 of the intake chamber 11 and the radial step 25, this control chamber being connected to a control line 27 for supplying a control medium into the control chamber 26. A lower stop (32) for the unloader ring (20) is provided in the intake chamber (11), this stop being designed so that the unloader finger overhang (f) of the unloader ring finger (21) is smaller than the intake stroke (h) of the intake valve (5).

7 Claims, 3 Drawing Sheets

(51) Int. Cl.

| | |
|---|---|
| ***F04B 39/08*** | (2006.01) |
| ***F04B 49/03*** | (2006.01) |
| ***F04B 39/10*** | (2006.01) |

(56) References Cited

U.S. PATENT DOCUMENTS

| | | | | | |
|---|---|---|---|---|---|
| 4,632,145 | A * | 12/1986 | Machu | F04B 49/243 | 137/516.21 |
| 5,785,081 | A * | 7/1998 | Krawczyk | F04B 49/243 | 137/516.19 |
| 8,500,420 | B2 * | 8/2013 | Spiegl | F04B 39/08 | 137/516.23 |
| 2010/0189581 | A1 * | 7/2010 | Wallis | F04B 27/24 | 417/505 |

* cited by examiner

CYLINDER HEAD FOR A PISTON COMPRESSOR

BACKGROUND OF THE INVENTION

Field of the Invention

The invention relates to a cylinder head for a piston compressor having an intake valve, a pressure valve and an unloader, wherein a ring-shaped intake chamber arranged on the inside or outside radially and a pressure chamber situated on the inside radially or on the outside radially are provided in the cylinder head, a unloader ring having a number of lifting fingers passing through the intake channels of the intake valve is arranged in the ring-shaped intake chamber, so that the unloader ring is guided displaceably on the wall of the intake chamber by the circumferential surface of the unloader ring on the outside radially or by the circumferential surface of the unloader ring on the inside radially, a radial step being provided on the circumferential surface of the unloader ring on the outside radially or on the circumferential surface of the unloader ring on the inside radially, and a control chamber which communicates with a control line for supplying a control medium into the control chamber is formed on the circumferential surface of the unloader ring on the outside radially or on the circumferential surface of the unloader ring on the inside radially, with a control chamber formed between the wall of the intake channel and the radial step connected to a control line for supplying a control medium into the control chamber.

The Prior Art

In many applications, high demands are made of the design height of a compressor in air brake compressors, e.g., for trucks. Likewise, idling control must often be provided with compressors, in particular compressors, which are driven even if no compression medium such as air is required at that time. An unloader is frequently used with many compressors, forcing the intake valve to remain open for a certain period of time. However, there are no known air brake compressors that use unloaders, and instead other devices are also used, e.g., pistons or movable slats, which open a borehole, or intake vanes, which are shifted. The unloader or the actuating device for same is therefore often situated on the cylinder head and has unloader fingers which are pressed against the valve element of the intake valve to lift it away from the valve seat and thus to keep it open. However, such unloaders according to the related art require a very large installation space, which therefore prevents their use in many applications. One such unloader is known from EP 475 931 A1 or EP 118 416 A1, for example.

U.S. Pat. No. 2,956,729 A in turn describes an unloader situated concentrically around the cylinder of the compressor. To do so, a ring-shaped step piston, which is in contact with a number of pins that are distributed over the circumference and extend through the intake channels in the valve seal and actuate the pins, is provided. A hollow space, which can be put under pressure via a hydraulic medium line may be placed between the movable step piston and the stationary inside part, so that the unloader is deactivated. To actuate the unloader, the intermediate space must be vented, so that the unloader keeps the intake valve open by spring force. One such unloader has a plurality of individual parts which makes it susceptible to error. The pins must also be guided in the valve seat, which reduces the available intake cross section by the intake valve on the one hand while limiting the possible number of pins on the other hand. In the case of a few pins, however, the surface pressure of the pins on the valve plate is increased, resulting in unwanted deformation, in particular warping of same, and thus resulting in a malfunction of the compressor.

U.S. Pat. No. 1,345,884 A shows an unloader having lifting pins situated in the cylinder head. The lifting pins are pressure-actuated directly, so that corresponding channels for the pressure medium must be provided in the cylinder head. This makes the cylinder head complicated and reduces the available flow cross sections for the pressure medium or the intake medium. Here again, the pins must be guided in the valve seat of the intake valve, which in turn reduces the available intake cross section due to the intake valve and limits the possible number of pins, with the same disadvantages as those described in U.S. Pat. No. 2,956,729 A.

FR 2 257 029 A1 describes a cylinder head of a piston compressor in which a unloader ring according to the preamble of the independent claim is derived. In normal operation, the unloader ring is lifted away from the valve element by a control medium against a spring. In the absence of a control pressure, the unloader ring is pressed by the spring against the valve element, lifting it away from the valve seat.

In idling operation, oil is transported from the crankcase into the cylinder chamber (the so-called oil carry-over). This has negative effects en the operation of the compressor because on the one hand the oil is transported outward and delivered to the environment and on the ether hand there may also be some chemical decomposition of the oil due to the high temperatures of the compression medium and/or of the cylinder head, such that the resulting substances may be problematical for units downstream from the compressor, for example, control valves for a brake system and may cause damages there.

The object of the present invention is therefore to provide a very compact cylinder head with unloaders which will eliminate the aforementioned disadvantages and will reduce the oil carry-over in idling operation.

SUMMARY OF THE INVENTION

This object is achieved according to the present invention in that a lower stop is provided for the unloader ring in the intake chamber, this stop being designed so that the lifting finger overhang of the unloader ring finger is smaller than the intake stroke of the intake valve. Thus, an extremely compact design of the cylinder head may be implemented because only a small control chamber on the inside or outside radially is required and this is also formed in part by the unloader ring. The control medium may be supplied through a simple borehole from the outside. The control chamber thus does not influence the intake chamber or pressure chamber of the cylinder head, which also helps to keep the design of the cylinder head simple. The unloader is formed essentially by a single component, the unloader ring, according to the invention, which makes the unloader simple, robust and reliable in operation. Furthermore, the unloader ring may be manufactured as a very favorable injection molded part or die-cast part, which also reduces the cost of the unloader ring. In addition, many unloader ring fingers distributed over the circumference may also be implemented in this way, which reduces the surface pressure on the valve element and reduces the warping of the valve element and advantageously also permits very thin light valve elements to be used. The unloader ring and/or the unloader ring fingers may also be dimensioned to be simple, despite the high number of possible unloader ring fingers so that the flow cross sections in the intake valve are influenced only insignificantly during normal operation. Due to the fact that the lower stop is designed so that the lifting finger protruding part of the unloader ring fingers is smaller than the intake stroke of the intake valve, a slightly increased excess pressure is built up in pushing out the compression medium through the intake valve which is necessarily kept open, thus restricting the transfer of oil out of the crankcase into the cylinder (the so-called oil carry-over).

An upper stop for the unloader ring is particularly advantageously provided in the intake chamber. Control of the lifting movement may be simplified in this way. On the other band the unloader ring may thus also be used with intake vane valves without a stop.

It is particularly advantageous to provide a spring element in the cylinder head which lifts the unloader ring from the intake valve to ensure a secure transition from idling operation to normal operation.

To increase the efficiency and performance of the compressor, it is possible to arrange an insulation shell on the unloader ring at a radial distance from it and connected to it by connecting webs. The heat transfer from the hot cylinder head wall to the intake gas flowing through the intake chamber can be reduced in this way.

BRIEF DESCRIPTION OF THE DRAWINGS

The present invention is explained in greater detail below with reference to FIGS. 1 through 5 which show advantageous embodiments of the invention as examples, drawn schematically and not restrictively, in which.

DETAILED DESCRIPTION OF THE DEPICTED EMBODIMENTS

Figure 1:
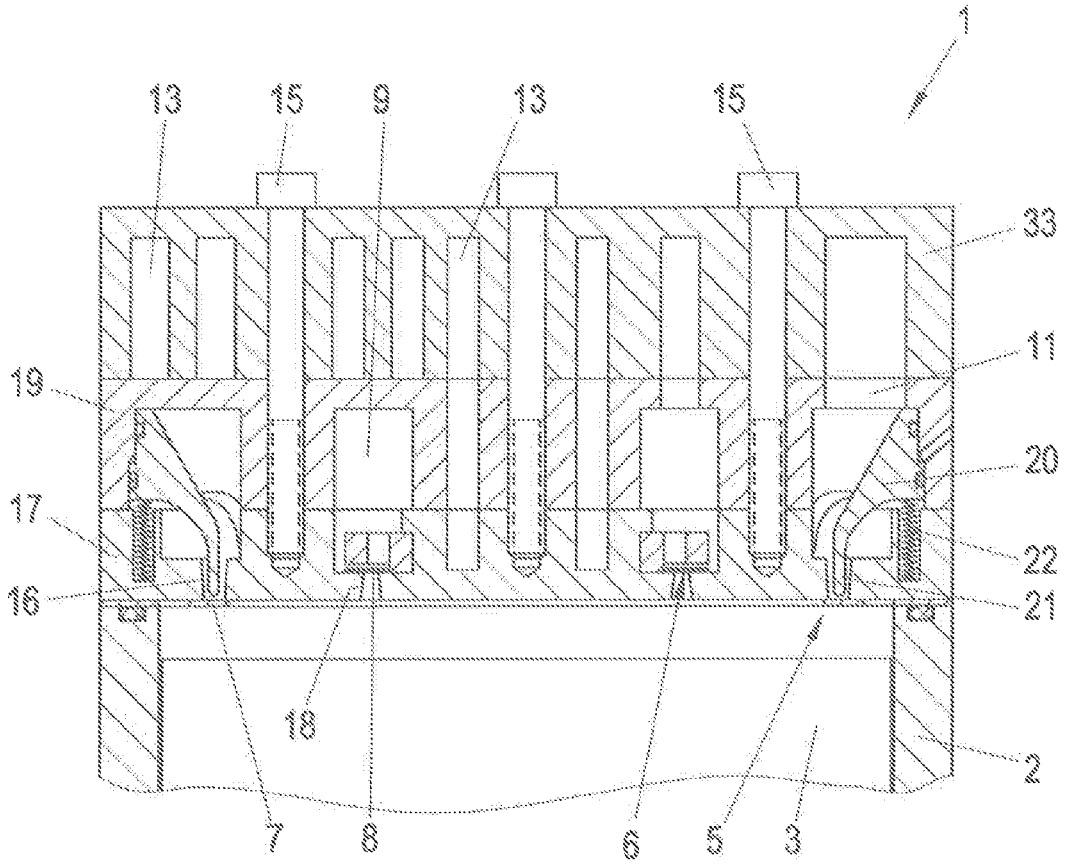
FIG. 1 shows a section through an inventive cylinder head with a unloader ring.
Figure 2:
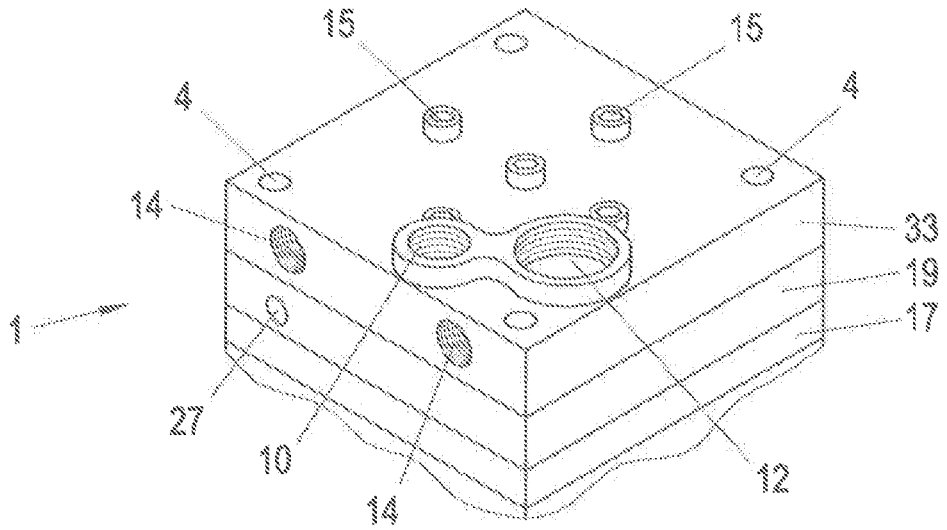
FIG. 2 shows a perspective view of the cylinder head.

The cylinder head 1 according to the invention, as shown in FIGS. 1 and 2, is attached to a cylinder 2 of a piston compressor such as an air brake compressor in the traditional way, e.g., by means of screws through the boreholes 4 in the cylinder head 1. A piston 3 moves in the cylinder 2 in a sufficiently well-known manner. An intake valve 5 having an intake valve element 7 and a pressure valve 6 having a pressure valve element 8 are arranged on the axial end of the cylinder head 1 facing the cylinder 2. The intake valve 5 here is arranged on the outside radially and the pressure valve 6 is arranged on the inside radially. The pressure valve 6 may be arranged essentially concentrically with the intake valve 5, instead of a concentric arrangement, the pressure valve 6 may also comprise a plurality of individual, essentially known pressure valve units arranged on the inside radially. The intake valve 5 and the pressure valve 6 are then no longer arranged concentrically but are at least arranged side by side radially. Likewise, the intake valve 5 may be arranged on the inside radially, with the pressure valve 6 arranged on the outside radially. To do so, flow-through channels 16, 18 for the intake valve 5 and the pressure valve 6 are also provided in the valve disk 17 in a known way.

Figure 3:
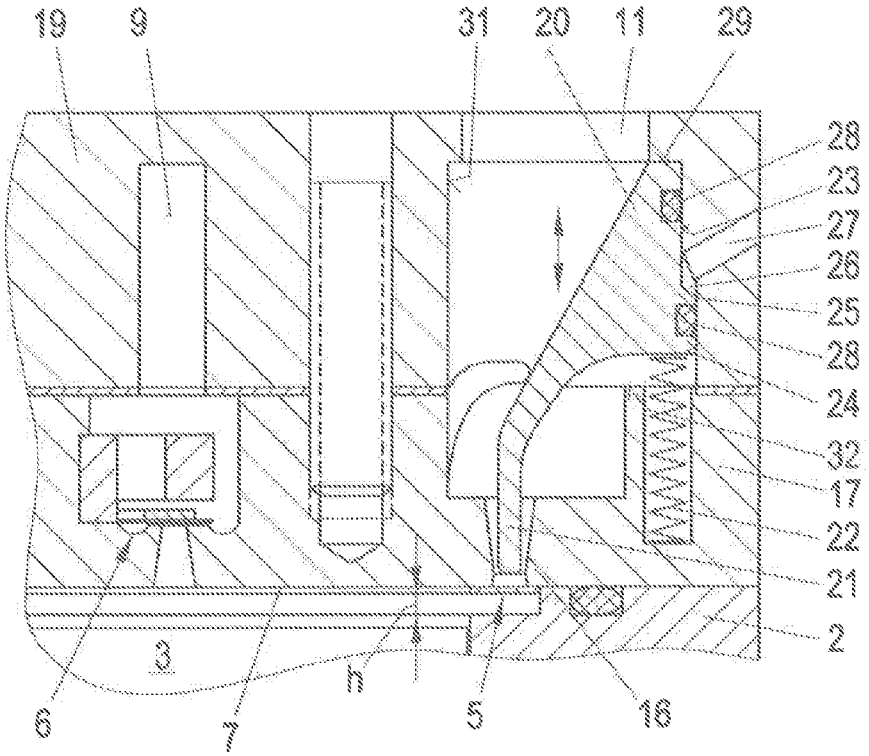
FIGS. 3 to 5 show preferred embodiments of the unloader ring in the cylinder head.
Figure 4:
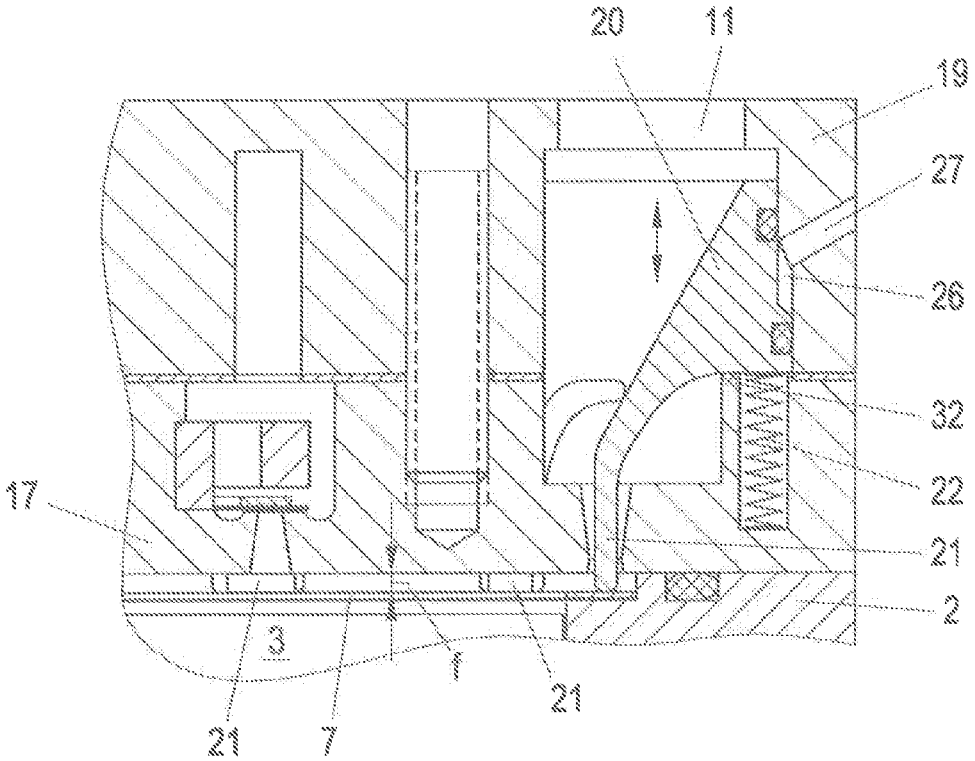
Figure 5:
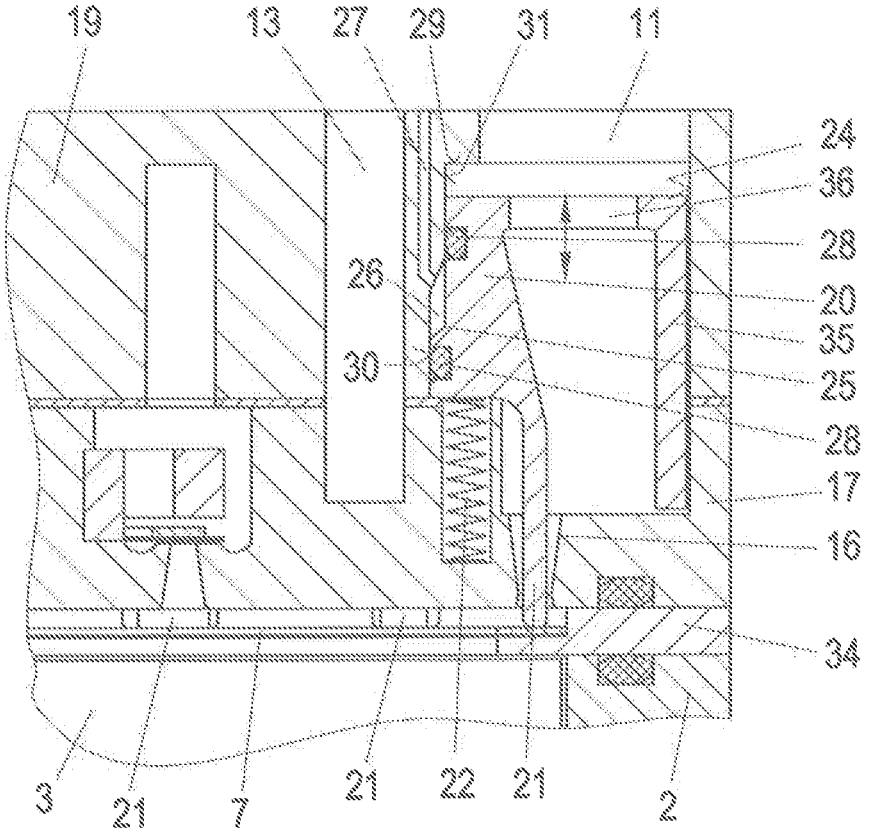

The intake valve element 7 may have different designs. For example, intake valve element 7 may be embodied with essentially known suspension link arms, in which the sealing plates are curved out of the sealing plane. The intake valve element 7 may be secured between the valve plate 17 and the cylinder 2, as indicated in FIG. 1. However, the intake valve element 7 may also be embodied as a spring-loaded sealing ring (e.g., by means of a zigzag spring), which is in contact with the valve plate 17 on the valve seat when closed and is on a valve stop when opened. The valve stop may be, for example, the cylinder 2, as indicated in FIGS. 3 and 4, where the intake valve is arranged on the outside radially of the inside diameter of the cylinder 2. However, a catcher disk 34 situated between the valve plate 17 and the cylinder 2 may also be used as shown in FIG. 5, in this case, the intake valve is situated on the inside of cylinder 2 radially. The intake valve element 7 may also be secured and guided to prevent twisting, e.g., by the suspension link arms, by arms arranged radially or by means of guide pins.

The design, arrangement and structural embodiment of such an intake valve 5 and pressure valve 6 and parts thereof are sufficiently well known, so they need not be discussed further here.

The pressure valve 6 is connected to a pressure chamber 9, which is en the inside radially here in the cylinder head 1, through which the compressed compression medium can be discharged to the outside through a pressure connection 10 on the cylinder head 1. The intake valve 5 is connected to an intake chamber 11 here en the outside radially in the cylinder head 1 through which the compression medium may be supplied through an intake connection 12. Depending on the radial arrangement of the intake valve 5 and the pressure valve 6, the radial positions of the intake chamber 11 and the pressure chamber 9 may also be exchanged.

A plurality of cooling channels 13 which may be supplied with cooling medium through the coolant connections 14 on the cylinder head 1 to cool the cylinder head 1 are provided on the axial end of the cylinder head 1 facing away from the cylinder 2.

The cylinder head 1 here consists of a number of plates adjacent to one another axially, here a valve plate 17, a chamber plate 19 and a cover 33 which are held together by screws 15 to facilitate the manufacturing and assembly of the cylinder head 1.

A ring-shaped unloader ring 20 having a plurality of lifter fingers 21 distributed around the circumference, passing through the intake channels 16 of the intake valve 5, is arranged in the intake chamber 11 of the cylinder head 1 as an unloader. The unloader ring 20 need not be a closed ring but may also be designed merely as a ring section, e.g., as a half ring, or in a sickle shape, which is also understood here to be ring-shaped. Likewise the unloader ring 20 need not be designed to be a circular ring but may also have a polygonal shape.

The unloader ring 20 may be made of a plastic, a fiber-reinforced plastic or a metal for example, aluminum, preferably manufactured in one piece, e.g., by injection molding, die casting, etc. The unloader ring 20 may also consist of a plurality of individual components, which are connected to form a unloader ring 20. In operational use, the unloader ring 20 is a single unit at any rate.

The number of unloader ring fingers 21 is preferably adapted to the stiffness of the Intake valve element 7. For example, if a very thin intake valve element 7 with a low stiffness is used, then a large number of unloader ring fingers 21 may be used to advantage to prevent an excessively high local surface pressure and also to prevent unwanted deformation, in particular warping of the intake valve element 7. In the case of a stiff intake valve element 7, fewer unloader ring fingers 21 may also be used accordingly.

The unloader ring 20 may also be prestressed by a spring element 22 arranged in the cylinder head 1, e.g., spiral springs distributed over the circumference or a zigzag spring so that it is lifted away from the intake valve element 7 of the intake valve 5 and/or is reset, also to reliably permit full-load operation again. The unloader ring 20 and its function are explained in greater detail below with reference to FIGS. 3 and 4.

The circumferential surface 23 of the unloader ring 20 on the outside radially is guided and arranged displaceably on the wall 24 of the intake chamber 11 on the outside radially. A radial step 25 is provided on the circumferential surface 23 of the unloader ring 20 on the outside radially, so that a control chamber 26 is formed between the wall 24 of the intake chamber 11 and the circumferential surface 23 of the unloader ring 20 on the outside radially, this control chamber being connected to a control medium supply, e.g., compressed air by means of a control line 27. Sealing elements 28, for example, O-rings are arranged on the unloader ring 20 or on the wall 24 of the intake chamber 11 on both sides of the control chamber 26 for sealing the control chamber 26.

The unloader ring 20 is moved away from the intake valve 5 by means of spring elements 22 when the control chamber 26 is ventilated, so that the unloader ring fingers 21 are lifted away from the valve element 7 and the unloader is then inactive—the compressor runs in normal operation and/or in full load operation then (FIG. 3). An upper stop 29, e.g., the upper wall of the intake chamber 11 may be provided in the intake chamber 11, the unloader ring 20 being in contact with this upper wall in normal operation. The upper slop 29 is arranged here in the area of the end of the intake chamber 11 facing away from the intake valve 5.

When the control chamber 26 is pressurized by a control medium, wherein the pressure of the control medium is set or regulated in accordance with requirements, the control medium acts on the radial step 25 of the unloader ring 20, so that the latter is moved against the spring bias in the direction of intake valve 5 until the unloader ring finger 21 comes in contact with the intake valve element 7 and necessarily raises it away from the valve seat and thus keeps the intake valve 5 open—while the compressor is running in idling mode (FIG. 4). In idling mode, the compressor forces the compression medium back into the intake chamber 11 in the compression stroke and thus throttles the delivery quantity and reduces efficiency. A lower stop 32, e.g., the lower wall of the intake chamber 11, or a separately molded stop with which the unloader ring 20 is in contact, which may also be adjustable under some circumstances, may be provided in the intake chamber 11. The lower stop 32 is arranged in the area of the end of the intake chamber 11 facing the intake valve 5. When the control medium is switched off, the unloader ring 20 is moved by the spring element 22 back into the starting position, as shown in FIG. 3.

The lower stop 32 is designed so that the intake stroke h of the intake valve 5 is greater than the ring finger overhang f. As a result, the flow cross section is greater in inflow of the compression medium during the intake stroke of the compressor during normal operation than in outflow through the intake valve 5 in idling mode when the intake valve element 7 is kept open by the unloader ring 20. An elevated, and in particular adjustable, excess pressure is therefore established in the cylinder space in outflow during idling mode, limiting the transport of oil out of the crankcase into the cylinder space (so-called oil carryover). This would have negative effects on operation because, on the one hand, the oil may be conveyed outward and released into the environment, while, on the other hand, there may also be chemical decomposition of the oil because of the high temperatures of the compression medium and/or of the cylinder head 1, such that the resulting substances may be problematical for units downstream from the compressor, such as control valves for a brake system, and may cause damage there (e.g., possibly attacking and damaging seals).

Specifically in the case of an intake valve element 7 having suspension link arms, a different flow cross section may be adjusted during outflow in comparison with the flow cross section in inflow during normal operation by means of a fitting adjustment of the ring finger overhang f and thus by means of the possible warping of the suspension link arms defined in this way and thus of the intake valve element 7 in order to build up an elevated, adjustable excess pressure again in expulsion of the compression medium out of the cylinder through the intake valve 5 during idling mode.

Instead of the spring element 22, a second radial step could be provided on the unloader ring 20 and a second control chamber could be provided between the unloader ring 20 and the wall 24 of the intake chamber 11 in order to lift up the unloader ring 20 by a pressurization of the second control chamber by the intake valve element 7.

The lifting movement of the unloader 20 and thus the opening behavior of the intake valve 5 can also be controlled during the entire compression cycle of the compressor by means of the control pressure of the control medium. It is also possible to implement a regulation of the delivery quantity, for example, in this way. To do so, it is possible to provide for the axial position of the unloader ring 20 to be detected by means of a suitable sensor and for the unloader ring position to be used in a closed control circuit for regulating the control pressure and/or for regulating the unloader ring position directly.

FIG. 5 shows an alternative embodiment of the unloader ring 20. The unloader ring 20 here is guided displaceably on its circumferential surface 30 on the inside radially and is arranged on the wall 31 of the intake chamber 11 on the inside radially. Otherwise the function and design of the unloader ring 20 are the same as those in the embodiment according to FIGS. 3 and 4. The control medium is again supplied through a control line 27, in this case, for example, through a borehole axially from the top in the control chamber 26.

The high temperatures of the compression medium that may result in the area of the pressure valve 6, e.g., typically up to 400° C. in the case of air brake compressors, could damage the sealing elements 28 by making them hard or brittle and ineffective. In the embodiment according to FIG. 5, a cooling channel 13 is therefore additionally arranged on the guide face of the unloader ring 20 on the inside radially, namely here the wall 31 of the intake chamber 11 to prevent overheating in this area.

Likewise, the unloader ring 20 may be arranged in the intake channel 11 with a twist-proof control to avoid contact of the unloader ring 20 with the valve plate 17. Pins, for example, may therefore be arranged in the valve plate 17 or the chamber plate 18, engaging in recesses on the unloader ring 20. Likewise, radially protruding guide lugs, which engage in grooves on the wall 24, 31 of the intake chamber 11 on the inside radially or on the outside radially, may be integrally molded on the unloader ring 20.

Despite cooling, the cylinder head 1 may become very hot so that the compression medium taken in would also be heated but as is known that would reduce the capacity and/or efficiency of the compressor. To diminish these problems, the unloader ring 20 may additionally be used as thermal insulation for the intake chamber 11, as shown in FIG. 5 as an example. For example, an additional external insulation shell 35 (as shown in FIG. 5) or internal insulation shell (as shown in the arrangement according to FIG. 3 or 4) may be integrally molded mounted on the unloader ring 20. The Insulation shell 35 and the unloader ring 20 are arranged at a distance from one another radially and could be joined together by radially arranged connecting webs 36, for example, which can be implemented easily in an injection melding or die molding process for a unloader ring 20 made of plastic. For example, the unloader ring 20 may have a U-shaped cross section as shown in FIG. 5. Then the upper part of the intake chamber 11 would also be at least partially thermally shielded by the connecting webs 36. Alternatively a number of spoke-type webs en which the insulation shell 35 is arranged could also be distributed over the circumference. Such a unloader ring 20 with an insulation shell 35 thus covers both the wall 24 on the inside radially and the wall 31 of the intake chamber 11 on the outside radially (in the case of a U-shaped embodiment, the upper wall would also be included), so that the heat input into the compression medium drawn in is reduced by the transfer of beat from the hot cylinder head 1 to the intake gas. The resulting air gap between the unloader ring 20 and the walls 24, 31 is also supported.

The cylinder head 1 described above could of course also be used for a two-step compressor. To do so, the intake valves and pressure valves of both compressor stages could be accommodated in the cylinder head 1. Likewise, a unloader ring 20 could be provided for both intake valves or Just for one intake valve.

The unloader ring 20 could also be used in normal operation of the compressor for an essentially known regulation of the delivery quantity in that the unloader 20 is controlled accordingly. Likewise the unloader ring 20 could be used for startup unloading in the case of a compressor with a coupling. On engagement of the coupling (and thus in startup of the compressor), the compressor could be set for idling mode for a certain period of time by means of the unloader ring 20 (as described above) and then the unloader ring 20 could be raised slowly again to prevent engagement of the coupling at full load.

The invention claimed is:

1. A cylinder head for a cylinder of a piston compressor, the cylinder head comprising:

a ring-shaped pressure chamber, a ring-shaped intake chamber radially inside or radially outside the ring-shaped pressure chamber relative to an axial line through the cylinder head, said ring-shaped intake chamber having a side wall with a fluid opening connected to a fluid passageway for delivering control fluid to the fluid opening, said intake chamber having a plurality of flow channels that extend through a bottom of the cylinder head to a bottom surface thereof, an intake valve element positioned at the plurality of flow channels and movable by an intake stroke distance (h) relative to the bottom surface to control flow of intake air through the flow channels, a unloader ring positioned in the ring-shaped intake chamber to move through the cylinder head along an axial line towards and away from the valve element, said unloader ring including a circumferential side wall defining a step which provides a variable volume control chamber with the side wall of the intake chamber, and said unloader ring including a plurality of unloader fingers which each extend along a corresponding flow channel, said unloader ring being movable towards and away from the valve element by control fluid flowing through the fluid passageway into the variable-volume control chamber so that the plurality of unloader fingers contact and move the intake valve element away from the bottom of the cylinder head an overhang distance (f) relative to the bottom surface, and a lower stop in the intake chamber for contacting and limiting movement of the unloader ring towards the bottom surface such that the overhang distance (f) is less than the stroke distance (h).

2. The cylinder head according to claim 1, including an upper stop in the intake chamber for contacting and limiting movement of the unloader ring away from the bottom surface.

3. The cylinder head according to claim 1, including a spring element for lifting the unloader ring away from the intake valve.

4. The cylinder head according to claim 1, including an insulation shell radially spaced from the unloader ring within the ring-shaped intake chamber and connected to said unloader ring by a plurality of spaced webs.

5. The cylinder head according to claim 1, wherein said sidewall is a radially outer circumferential wall of said ring-shaped intake chamber.

6. The cylinder head according to claim 1, wherein said side wall is a radially inner circumferential wall of said ring-shaped intake chamber.

7. A piston compressor which comprises a cylinder with a reciprocating piston therein and a cylinder head, said cylinder head comprising:

a ring-shaped pressure chamber, a ring-shaped intake chamber radially inside or radially outside the ring-shaped pressure chamber relative to an axial line through the cylinder head, said ring-shaped intake chamber having a side wall with a fluid opening connected to a fluid passageway for delivering control fluid to the fluid opening, said intake chamber having a plurality of flow channels that extend through a bottom of the cylinder head to a bottom surface thereof, an intake valve element positioned at the plurality of flow channels and movable by an intake stroke distance (h) relative to the bottom surface to control flow of intake air through the flow channels, a unloader ring positioned in the ring-shaped intake chamber to move through the cylinder head along an axial line towards and away from the valve element, said unloader ring including a circumferential side wall defining a step which provides a variable volume control chamber with the side wall of the intake chamber, and said unloader ring including a plurality of unloader fingers which each extend along a corresponding flow channel, said unloader ring being movable towards and away from the valve element by control fluid flowing through the fluid passageway into the variable-volume control chamber so that the plurality of unloader fingers contact and move the intake valve element away from the bottom of the cylinder head an overhang distance (f) relative to the bottom surface, and a lower stop in the intake chamber for contacting and limiting movement of the unloader ring towards the bottom surface such that the overhang distance (f) is less than the stroke distance (h).

* * * * *